US006176091B1

(12) United States Patent
Kishi et al.

(10) Patent No.: US 6,176,091 B1
(45) Date of Patent: Jan. 23, 2001

(54) METHOD AND APPARATUS FOR PREVENTING SNOW FROM MELTING AND FOR PACKING SNOW IN ARTIFICIAL SKI FACILITY

(75) Inventors: Susumu Kishi; Kazuhiko Kamesaki, both of Tsu (JP)

(73) Assignee: NKK Corporation, Tokyo (JP)

( * ) Notice: Under 35 U.S.C. 154(b), the term of this patent shall be extended for 0 days.

(21) Appl. No.: 09/169,733

(22) Filed: Oct. 9, 1998

(51) Int. Cl.[7] ..... F25C 3/04
(52) U.S. Cl. ..... 62/70; 62/307
(58) Field of Search ..... 62/69, 70, 307

(56) References Cited

FOREIGN PATENT DOCUMENTS

| | | |
|---|---|---|
| 2325298 | 11/1998 | (GB) . |
| 1-293887 | 11/1989 | (JP) . |
| 2-240304 | 9/1990 | (JP) . |
| 3-028405 | 2/1991 | (JP) . |
| 3-093905 | 4/1991 | (JP) . |
| 3-166404 | 7/1991 | (JP) . |
| 3-180604 | 8/1991 | (JP) . |

OTHER PUBLICATIONS

PAJ Abstract of JP 4176901 (Toukiyou Gasu Enjiniaringu KK), Jun. 24, 1992.

*Primary Examiner*—William E. Tapolcai
(74) *Attorney, Agent, or Firm*—Frishauf, Holtz, Goodman, Langer & Chick, P.C.

(57) ABSTRACT

A method for preventing snow from melting and for packing a snow cover in an artificial ski facility, by injecting dry air or low-temperature air to permeate through a snow cover of an artificial ski facility. The entirety of the snow cover can be effectively cooled to reliably prevent snow from melting and to pack the snow cover as well. If high-temperature air is injected before the injection of the low-temperature air, the low-temperature air is permeated effectively and formation of frozen snow is prevented by the high-temperature air injected thereafter. In these methods, snow can be prevented from melting and the packing of the snow cover can be achieved more effectively, if the dry air, the low-temperature air, and the high-temperature air are injected from the bottom of the snow cover, through a header having a plurality of air injecting outlets. The header is preferably constructed in a tortuous or snake-shape or in a lattice, on a platform of the ski facility.

18 Claims, 4 Drawing Sheets

METHOD AND APPARATUS FOR PREVENTING SNOW FROM MELTING AND FOR PACKING SNOW IN ARTIFICIAL SKI FACILITY

BACKGROUND OF THE INVENTION

1. Field of the Invention

The present invention relates to a method and an apparatus for preventing snow from melting and for packing snow in an indoor or outdoor artificial ski facility for skiing or snow-boarding.

2. Description of Related Art

In order to prevent snow from melting in an artificial ski facility, various methods have been disclosed in publications such as Japanese Patent Laid-Open No. 1-293887/1989, the related art (1); Japanese Patent Laid-Open No. 3-28405/1991, the related art (2); Japanese Patent Laid-Open No. 3-166404/1991, the related art (3); Japanese Patent Laid-Open No. 3-180604/1991, the related art (4); Japanese Patent Laid-Open No. 2-240304/1990, the related art (5); and Japanese Patent Laid-Open No. 3-93905/1991, the related art (6).

JP 1-293887/1989 discloses a method for preventing a snow cover on a platform from melting by circulating a refrigerant through cooling pipes embedded in the platform.

JP 3-28405/1991 discloses a method for preventing a snow cover on a platform from melting by transferring heat from a heat-pipe evaporator embedded directly below the surface of the platform to a heat-pipe condenser disposed on the ground such that heat around the evaporator is absorbed when the ambient air temperature drops below that of the platform.

JP 3-166404/1991 discloses a method for preventing a snow cover on a platform from melting by covering the top surface of the platform with a water-permeable thermal insulator covered with a non-woven synthetic fabric.

JP 3-180604/1991 discloses a method for preventing a snow cover on a platform from melting by covering the top surface of the platform with a snow-support sheet comprising a textile base sheet with a plastic foam thermal insulator formed on the underside thereof.

JP 2-240304/1990 discloses a method for preventing a snow cover on a platform from melting by accommodating thermal insulating members in frameworks arrayed in a lattice on the platform.

JP 3-93905/1991 discloses a method for preventing a snow cover on a platform from melting by forming a thermal insulating layer in a waterproof membrane on the platform, by constructing a retaining plate in a waterproof membrane on the heat insulating layer, and by forming a drainage channel on the retaining plate.

In these known methods, if the ambient temperature in an artificial ski facility is below 0° C., since thermal transfer from the top surface of the snow is relatively small, preventing the snow from melting is possible to some extent by using some means to insulate against thermal transfer from the ground.

However, when the ambient temperature in an artificial ski facility exceeds 0° C. and radiant heat is substantial as well, the above disclosed related arts (1) to (6) have problems as described below.

In the methods in JP 1-293887/1989 and JP 3-28405/1991, only the snow around the cooling pipes is cooled and the cooling efficiency of the snow at a distance from the cooling pipes is low because of high thermal insulation of snow with interstitial spaces. The surface snow layers, especially where sensible heat and radiant heat penetrate, cannot be prevented from melting.

In the methods in which a thermal insulating sheet or a thermal insulating material is disposed at the bottom of the snow or on the platform, as in JP 3-166404/1991, JP 3-180604/1991, JP 2-240304/1990 and JP 3-93905/1991, although insulation against thermal transfer from the ground is to some extent possible, insulation against thermal transfer from the top surface of the snow is impossible and fails to prevent the snow at the surface layers from melting.

In the methods in JP 1-293887/1989 and JP 3-280405/1991, there is also the following problem. As melted snow penetrates from a surface snow layer to a lower snow layer due to gravity and freezes into ice around the cooling pipes, the ice gradually grows into a frozen mass at the bottom of the snow cover due to the inflow of the melted snow, and this continues growing toward the surface snow layer until finally almost all the snow cover is converted into a frozen ski slope. Such a frozen ski slope is so hard that it results in disadvantages such as difficulty in riding on edges of skis, which may easily cause falling, requiring substantial time for slope maintenance, and difficulty in applying new snow due to the impossibility of replacement.

The method in JP 3-166404/1991 also has a problem in that with an increase in the ambient temperature, the rate of snow melting increases so much that hardness and shearing strength of the snow are significantly reduced. This results in decreasing of the suitability of the slope for skiing.

SUMMARY OF THE INVENTION

Accordingly, it is an object of the present invention to provide a method and an apparatus for preventing snow from melting and for packing snow in an artificial ski facility to reliably prevent the entirety of the snow from melting and to pack the snow as well.

The aforementioned object can be achieved by the methods and apparatus according to the present invention.

A method according to the present invention of preventing snow from melting and for packing a snow cover in an artificial ski facility involves injecting dry air into the snow cover.

In another method according to the present invention, instead of the dry air, low-temperature air is injected at a temperature from −30° C. to 0° C. into the snow cover. Such method is similarly effective for preventing snow from melting and for packing a snow cover in an artificial ski facility.

A further method of preventing snow from melting and for packing a snow cover in an artificial ski facility comprises forming a plurality of holes in the snow cover from a top surface of the snow cover towards a bottom surface of the snow cover and injecting low-temperature air in the snow cover.

An additional method of preventing snow from melting and for packing a snow cover in an artificial ski facility comprises providing cooling pipes on a platform, covering the cooling pipes with a water absorber member, supplying water to the water absorber member, introducing a refrigerant into the cooling pipes and piling up snow on the water absorber member.

The present invention is also directed to an apparatus for preventing snow from melting and for packing snow in an artificial ski facility comprising a header, i.e., piping, disposed on a platform having a plurality of injection outlets, and an air supply source for supplying low-temperature air or high-temperature air to the header, i.e., into the piping. In a preferred embodiment of this apparatus, to prevent formation of a frozen slope, heaters are provided around the plurality of injection outlets formed in the piping.

The present invention also relates to an apparatus for preventing snow from melting and for packing snow in an artificial ski facility comprising a cooling piping header disposed on a platform, a water absorber member, such as a water absorption polymer (such that water can be absorbed by the water absorber member) covering the cooling piping header, and a source of refrigerant for supplying refrigerant into the cooling piping header.

BRIEF DESCRIPTION OF THE DRAWINGS

For the purpose of illustrating the invention, there is shown in the drawings forms which are presently preferred. It is to be understood, however, that the present invention is not limited to the precise arrangements and instrumentalities depicted in the drawings.

DETAILED DESCRIPTION OF THE INVENTION

In the method of the present invention comprising injecting dry air into a snow cover, it is preferable that the temperature (° C.) x and the relative humidity (%) y of the dry air be adjusted to satisfy the following equations:

$$y \leqq -5x + 100 \quad (1)$$

$$-30 \leqq x \leqq 10 \quad (2)$$

$$0 \leqq y < 100 \quad (3)$$

To inject the above disclosed dry air or the temperature-and-relative-humidity adjusted dry air into the snow cover, it is preferable to inject the air through a header, i.e., piping having a plurality of injection outlets, disposed on a platform in an artificial ski facility.

After injecting this low-temperature air, injecting high-temperature air at a temperature from 0° C. to 30° C. is effective for preventing the formation of a frozen slope. It is also preferable to inject the high-temperature air at a temperature from 0° C. to 30° C. before injecting the low-temperature air.

In a preferred embodiment, low-temperature air is injected into the snow cover after forming a plurality of holes from the top surface of the snow cover towards the platform. Such embodiment is as effective as injecting high-temperature air before injecting low-temperature air, which is disclosed above. Furthermore, after injecting low-temperature air, the injection of high-temperature air at a temperature from 0° C. to 30° C. enables prevention of the formation of a frozen slope.

It is preferred that the injecting of the low-temperature or the high-temperature air as disclosed above be carried out through piping having a plurality of injection outlets, disposed on a platform of an artificial ski facility.

Figure 1:
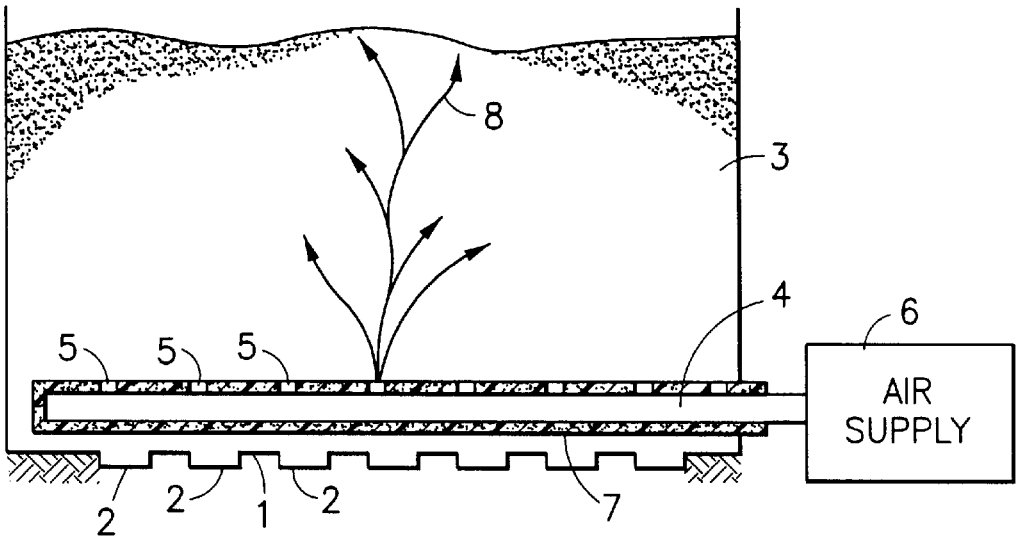
FIG. 1 is a sectional side view illustrating an embodiment for carrying out the method of the present invention.
Figure 2:
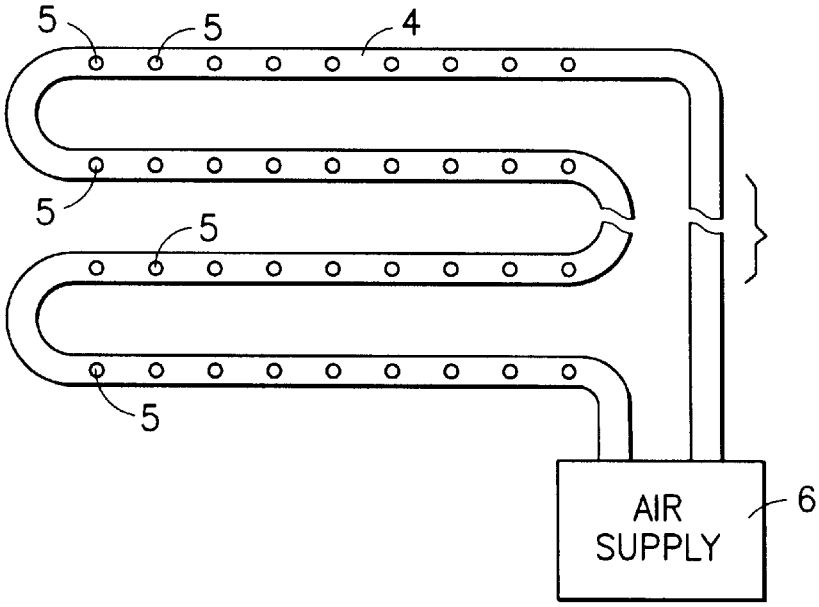
FIG. 2 is a schematic top plan view of the apparatus in FIG. 1.

Since the temperature of a snow cover in an artificial ski facility is almost at 0° C., the "snow" is comprised of particles of ice and melted snow mixed together, and further including numerous interstices in the "snow". Therefore, as shown in FIG. 1, dry air, injected in the snow cover 3, permeates along paths 8 in the snow cover 3 through the interstices so as to be vented into the air. As shown in FIGS. 1 or 2, for example, the dry air is supplied through piping comprising a header 4 constructed in a tortuous or snake-shape or in a lattice on a platform 1 having drainage gutters 2. The header 4 is covered with a heat insulator 7 The heat insulator 7 can be a material that is generally used for city water supply pipes and tubes, and thus the heat insulator 7 can be polyurethane form foam or polystyrene. The header 4 has a plurality of air injection outlets 5. The header 4 is connected to a source of air supply 6 having an air compressor or an air blower and a dehumidifier (not shown in FIG. 1).

As the dry air permeates along paths 8 in the snow cover 3, melted snow in the snow cover 3 evaporates, being taken up by the dry air, to remove the heat of evaporation from the snow cover 3. That is, due to the permeating dry air, the snow 3 is cooled to prevent the snow from melting, and this also increases the hardness and shearing strength of the snow cover 3. This results in preventing the snow from melting, while packing the snow as well. Since the air vented from the surface of the snow cover 3 is at a temperature of about 0° C. and has a higher density than that of the ambient air, it flows over the surface of the snow cover 3 in a laminar manner to block (i.e., insulate against) sensible heat from the ambient air, thereby preventing condensation from developing. This is therefore advantageous for preventing snow from melting and for packing the snow.

Figure 3:
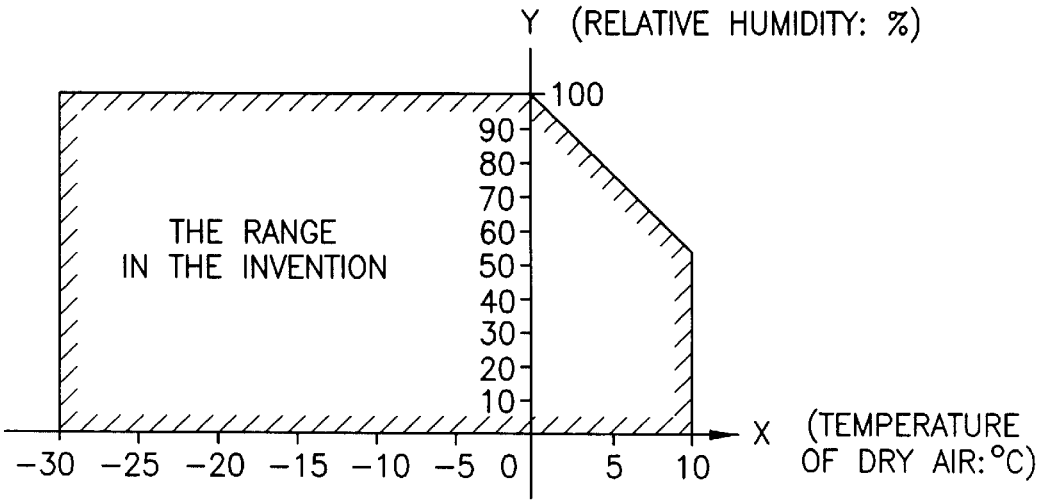
FIG. 3 is a graph illustrating a preferred range of temperature and relative humidity of dry air.

It is also effective for preventing snow from melting and for packing the snow to control the relative humidity (%) y and the temperature (° C.) x of the supplied dry air to values within the diagonally hatched range in FIG. 3.

Figure 4:
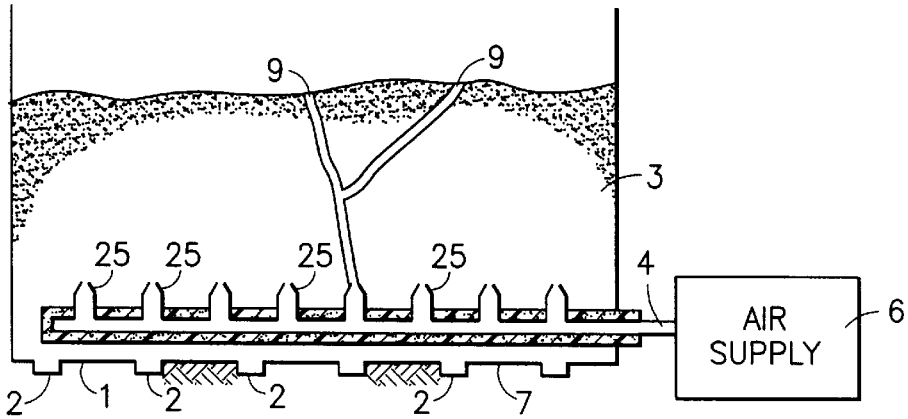
FIG. 4 is a sectional side view illustrating a second embodiment for carrying out the method of the present invention.
Figure 5:
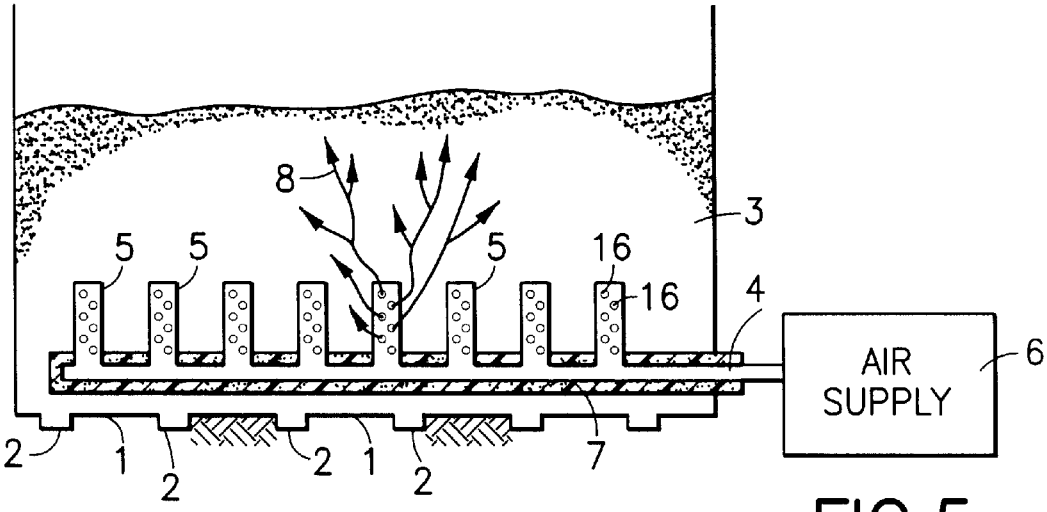
FIG. 5 is a sectional side view illustrating a third embodiment for carrying out the method of the present invention.

While the header 4 has air injection outlets 5 in the form of perforations as shown in FIG. 1, air injection outlets 25 in the form of protruding nozzles, as shown in FIG. 4, are similarly effective. When the header 4 having a plurality of protrusions having a plurality of perforations 16 therethrough is provided with air, as shown in FIG. 5, the air can more effectively permeate into the snow cover 3 under low pressure.

It is similarly effective, instead of the dry air, to inject low-temperature air at a temperature from −30° C. to 0° C. into the snow cover 3. As shown in FIG. 4, for example, when the low-temperature air is injected into the snow cover 3 from the nozzle-shaped air injection outlets 25, ventilating paths or openings 9, which communicate even to the surface of the snow cover 3, are formed in the whole of the snow cover 3 as the low-temperature air passes through the snow cover 3. At this time, while one portion of the supplied low-temperature air is vented to the ambient air from the surface of the snow cover 3 through the ventilating paths or openings 9, the other remaining portion of the low-temperature air permeates into the snow cover 3 through the walls of the ventilating paths or openings 9. Prevention of the snow from melting and packing of the snow as well are thereby achieved by the same mechanism as that of the above described dry air. When the low-temperature air is permeated into the snow cover 3 from the platform 1 side, since cooling of the snow cover 3 is performed from lower layers to higher layers of the snow cover 3 in order, the hardness and the shearing strength of the snow cover 3 of lower layers are greater than those of higher layers. That is, the snow cover 3 is packed so that the hardness of the snow cover 3 increases gradually downward from higher layers to lower layers.

When the low-temperature air is injected continuously, the portion of the snow around the ventilating paths or openings 9 can be frozen to prevent permeation of the low-temperature air. In such a case, after injection of the low-temperature air, injection of the high-temperature air at a temperature from 0° C. to 30° C. enables melting of the frozen snow. Then, injection of the low-temperature air for the second time enables preventing of snow from melting and for packing of the snow.

Injection of the high-temperature air at a temperature from 0° C. to 30° C. before the injection of the low-temperature air reliably enables formation of the ventilating paths or openings 9, which communicate even to the surface of the snow cover 3, in the whole of the snow cover 3 to achieve preventing of snow from melting and for packing of the snow.

Figure 6:
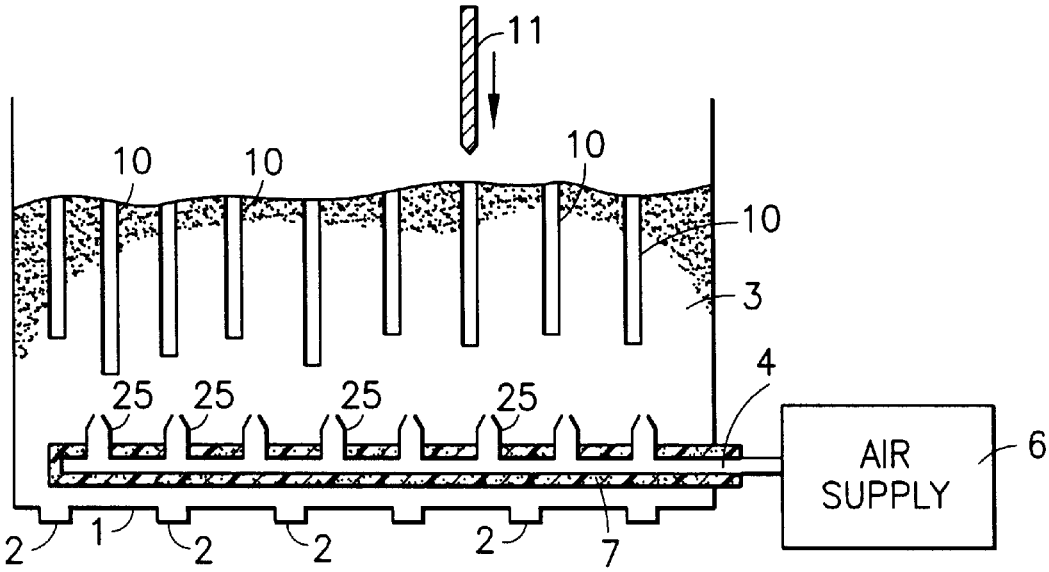
FIG. 6 is a sectional side view illustrating a fourth embodiment for carrying out the method of the present invention.

When injecting the low-temperature air through a plurality of holes or bores 10, which are formed from the top surface of the snow cover 3 towards the platform 1 by a drill 11, for example, as shown in FIG. 6, it is also equally effective as the effect of the above disclosed injection of the high-temperature air before the injection of the low-temperature air. If the high-temperature air at a temperature from 0° C. to 30° C. is injected through nozzles (air injection outlets) 25 after injection of the low-temperature air through holes or bores 10, formation of frozen snow around the holes or bores 10 can be prevented.

It is also effective for permeating the above described dry air, the low-temperature air, and the high-temperature air in the whole of the snow cover 3 to inject the air from the header 4 disposed on the platform, having a plurality of air injection outlets 5, as shown in FIG. 1 and air injection outlets 25 as shown in FIGS. 4, 5, 6 and 7.

The above disclosed methods can be performed when using an apparatus for preventing snow from melting and for packing snow in an artificial ski facility comprising a header 4 disposed on a platform, having a plurality of air injection outlets 5, as shown in FIG. 1 and air injection outlets 25 shown in FIGS. 4, 5, 6 and 7, and a source of air supply 6 for supplying the header 4 with the low-temperature air or the high-temperature air.

Figure 7:
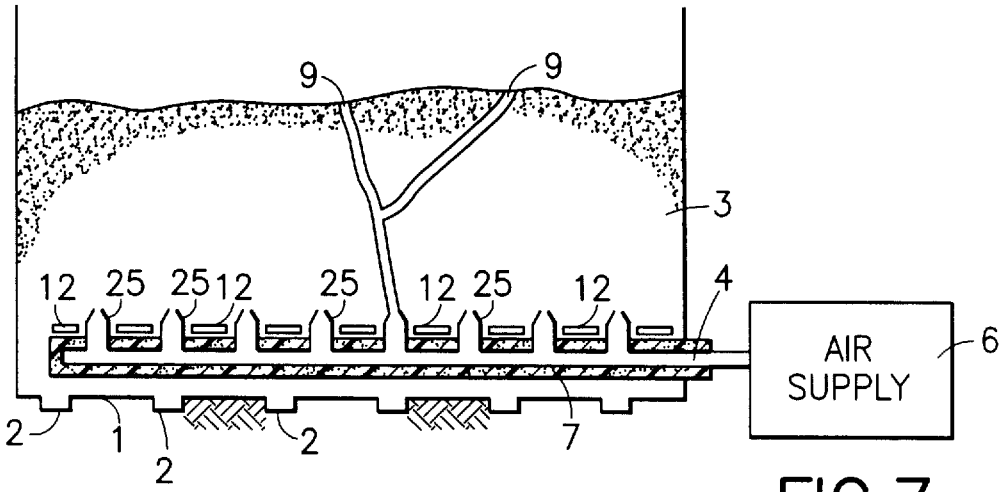
FIG. 7 is a sectional side view illustrating a fifth embodiment for carrying out the method of the present invention.

It is also effective for melting a frozen snow, as shown in FIG. 7, to provide heaters 12 to a plurality of air injection outlets 25 around them, which are disposed at the header 4 of an apparatus for preventing snow from melting and for packing snow in an artificial ski facility, instead of injection of high-temperature air.

With respect to all of the embodiments of the present invention disclosed hereinabove, the preferred flowrate of injected air is 5 to 100 normal liters/minute/$m^2$ (per unit area of snow). The preferred duration of air injection is 2 to 30 hours. The preferred diameter of the air injection outlets (5, 25) is less than 10 mm, and the preferred distance between the air injection outlets (5, 25) is less than 1,000 mm (normally about 600 mm). The above parameters for the injected air apply to both low-temperature air and high-temperature air.

Figure 8:
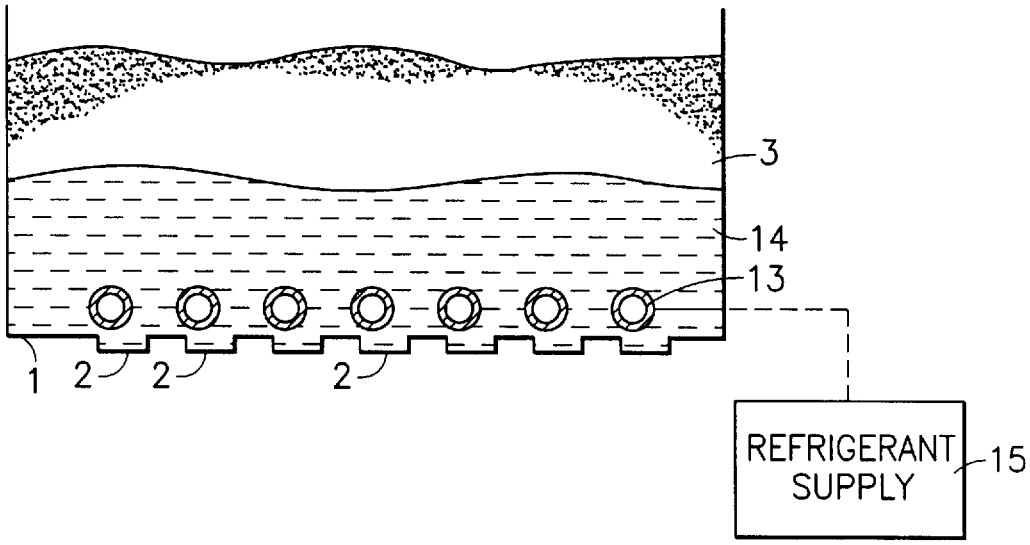
FIG. 8 is a sectional side view illustrating a sixth embodiment for carrying out the method of the present invention.

As shown in FIG. 8, which depicts another embodiment of the present invention, cooling piping header 13 is disposed on the platform 1 and is covered by a water absorber member 14, such as a water absorption polymer, for example, a "Super Absorbent Polymer" ("SAP") such as cross-linked-polyacrylic soda. The water absorber member 14 has a heat transfer coefficient of preferably 0.10 to 0.56 W/m deg., depending on specific conditions. The thickness of the water absorber member 14 is preferably 30 to 40 cm when the distance from the platform 1 to the snow cover 3 is 50 to 60 cm. Water is supplied to the water absorber member 14 and then a refrigerant (such as low-temperature air or ethylene glycol, which is preferably supplied at a temperature of 30° to 0° C.) is supplied into the cooling piping header 13 from a refrigerant supply 15, and snow is piled up on the water absorber member 14. Since the snow is piled up on the frozen water absorber member 14, the snow is prevented from melting, and hardening of the snow as well can be achieved. In this method, since the snow is cooled by the water absorber member 14, the snow around the cooling piping header 13 cannot be frozen. Before piling up new snow, in this method, old snow should be melted by supplying the cooling piping header 13 with a heating medium such as high-temperature air and heating the water absorption member 14.

When snow packed by the above disclosed methods is used in an indoor or outdoor artificial ski facility, the snow cover can always be maintained in good condition, withstanding several tens of thousands times of use by skiing or snow-boarding per day, and this will avoid deterioration of skiing action due to the loss of snow at the surface of the snow-pack. Since the snow is packed, avalanches will not occur, even on a steep platform.

It will be appreciated that the instant specification is set forth by way of illustration and not limitation, and that various modifications and changes may be made without departing from the spirit and scope of the present invention.

What is claimed is:

1. A method of preventing snow from melting and for packing a snow cover in an artificial ski facility, comprising injecting dry air into said snow cover, wherein said dry air is at a temperature x in 0° C. and at a relative humidity % y which satisfies the following equations:

$$y \leqq -5x + 100$$

$$-30 \leqq x \leqq 10$$

$$0 \leqq y < 100.$$

2. The method according to claim 1, wherein said dry air is injected through a header disposed on a platform, said header having a plurality of injection outlets.

3. A method of preventing snow from melting and for packing a snow cover in an artificial ski facility, comprising injecting low-temperature air at a temperature from −30° C. to 0° C. in said snow cover.

4. The method of claim 3, wherein the low-temperature air is injected for 2 to 30 hours at a flowrate of 5 to 100 liter/minute/$m^2$ per unit area of snow.

5. The method according to claim 3, further comprising injecting high-temperature air at a temperature from 0° C. to 30° C. after said injecting of said low-temperature air.

6. The method according to claim 3, further comprising injecting high-temperature air at a temperature from 0° C. to 30° C. before said injecting of said low-temperature air.

7. The method according to claim 6, wherein both the low-temperature air and the high-temperature air are injected for 2 to 30 hours at a flowrate of 5 to 100 normal liters/minute/$m^2$ per unit area of snow.

8. The method according to claim 3, wherein said low-temperature air is injected through a header disposed on a platform, said header having a plurality of injection outlets.

9. The method according to claim 5, wherein said low-temperature air or said high-temperature air is injected through a header disposed on a platform, said header having a plurality of injection outlets.

10. The method according to claim 6, wherein said low-temperature air or said high-temperature air is injected through a header disposed on a platform, said header having a plurality of injection outlets.

11. A method of preventing snow from melting and for packing a snow cover in an artificial ski facility, comprising:

forming a plurality of holes in said snow cover from a top surface of said snow cover towards a bottom surface of said snow cover; and injecting low-temperature air in said snow cover.

12. The method according to claim 11, further comprising injecting high-temperature air at a temperature from 0° C. to 30° C. after injection of said low-temperature air.

13. The method according to claim 11, wherein said low-temperature air is injected through a header disposed on a platform, said header having a plurality of injection outlets.

14. The method according to claim 12, wherein said low-temperature air or said high-temperature air is injected through a header disposed on a platform, said header having a plurality of injection outlets.

15. An apparatus for preventing snow from melting and for packing a snow cover in an artificial ski facility, comprising:

a header disposed on a platform, said header having a plurality of injection outlets; and a source of air supply for supplying said header with low-temperature air and then with high-temperature air, said high-temperature air being supplied at a temperature from 0° C. to 30° C. in order to melt frozen snow formed around said injection outlets.

16. The apparatus according to claim 15, wherein a plurality of heaters are disposed around said plurality of said injection outlets disposed at said header.

17. The apparatus according to claim 15, wherein said header is in a tortuous shape and is covered with a heat insulator selected from the group consisting of polyurethane foam and polystyrene; the injection outlets having a diameter of less than 10 mm and the distance between the injection outlets being less than 1,000 mm.

18. The apparatus according to claim 15, wherein the injection outlets are in the form of protruding nozzles having one or more perforations therethrough.

* * * * *